US005353473A

United States Patent [19]

Sherick

[11] Patent Number: 5,353,473

[45] Date of Patent: Oct. 11, 1994

[54] BOTTOM FIXTURE FOR OVERHEAD GARAGE DOORS

[76] Inventor: Thomas G. Sherick, 6931 Prairie Village, Katy, Tex. 77449

[21] Appl. No.: 45,302

[22] Filed: Apr. 12, 1993

[51] Int. Cl.[5] ..... E05D 13/00; E05D 15/24

[52] U.S. Cl. ..... 16/97; 16/DIG. 1; 16/DIG. 23; 160/207

[58] Field of Search ..... 16/97, 102, 107, DIG. 1, 16/DIG. 7, DIG. 20, DIG. 23, DIG. 31, DIG. 8, 98; 160/191-193, 201, 207

[56] References Cited

U.S. PATENT DOCUMENTS

| | | | |
|---|---|---|---|
| 1,059,981 | 4/1913 | Cross | 160/207 |
| 2,567,763 | 9/1951 | Clark | 16/97 |
| 2,694,214 | 11/1954 | Hammer | 16/97 |
| 3,101,776 | 8/1963 | Voris | 160/207 |
| 3,815,657 | 6/1974 | Malek et al. | 160/201 |

*Primary Examiner*—Lowell A. Larson
*Assistant Examiner*—Donald M. Gurley
*Attorney, Agent, or Firm*—Kenneth A. Roddy

[57] ABSTRACT

A bottom fixture for overhead garage doors which can be selectively installed on the lower portion of either the right hand or left hand side of the garage door. The bottom fixture is an L-shaped bracket having a wide flat side and a narrow flat side at right angles to one another. A first pair of parallel laterally spaced ear members and a second pair of parallel laterally spaced ear members extend perpendicular to the same surface of the wide side and each pair is spaced a predetermined distance from the top and bottom ends of the bracket and each pair of laterally spaced ears has axially aligned apertures on a horizontal axis to receive the shaft of a roller device having a roller rotatably mounted at its outer end. A first and second sheave extend perpendicular to the same surface of the narrow side on a horizontal axis and are spaced from the top and bottom ends a predetermined distance and are configured to receive a cable. The bracket member can be selectively inverted and secured on either the right hand side or left hand side of the overhead garage door with the shaft of the roller device selectively installed in either of the first or said second pair of ears with the roller disposed on the outer side edge of the overhead garage door and with the first and second sheaves disposed on the outer side edge of the overhead garage door and the cable slidably engaged with the lowermost sheave. The bracket may also be made with only a pair of sheaves or with only two pairs of ears.

15 Claims, 1 Drawing Sheet

BOTTOM FIXTURE FOR OVERHEAD GARAGE DOORS

BACKGROUND OF THE INVENTION

1. Field of the Invention

This invention relates generally to overhead garage doors, and more particularly to a bottom fixture for overhead garage doors which can be installed on either side of the garage door.

2. Brief Description of the Prior Art

Overhead garage doors are used as closures for large door openings in garages and warehouses. The conventional sectional overhead garage door is formed of a plurality of horizontally oriented rectangular sections hinged together along adjacent longitudinal edges. Roller brackets are mounted on the laterally opposed ends of the horizontal sections which have small wheels or rollers. The rollers of the roller brackets ride in laterally opposed tracks having a vertical portion mounted at each side of the door opening and curve at their top ends to form a horizontal portion which is mounted parallel to the ceiling of the enclosure. When the overhead garage door is opened it is raised vertically from a vertical position to a horizontal position inside the enclosure.

Bottom brackets are mounted at the bottom of the laterally opposed edges of the lowermost horizontal section of the door and have outwardly facing sheaves. Pulleys are mounted at the top of each side of the door opening. A cable attached at one end to a tension spring mounted on the horizontal portion of each track and extends horizontally passing over the pulley then vertically downward passing under the sheave of the bottom bracket and then vertically upward where it is secured to the track. When the door is opened the spring tension in the cables pulling upwardly on the bottom brackets assist in lifting the heavy door.

The conventional bottom bracket is L-shaped in transverse cross section forming a wide flat side and a narrow flat side at right angles to one another. When installed, the wide side fits on the horizontal side of the door and the narrow side fits on the side edge of the door facing the track. The wide side has a pair of parallel laterally spaced ears that extend perpendicular to the surface near the bottom end and have axially aligned apertures which receive the shaft of a roller. The narrow side has a sheave which extends perpendicular to the surface at the bottom end below the axis of the ears and parallel thereto.

The particular construction of the conventional bottom brackets presents a problem in that they can only be installed on the right hand side or the left hand side of the garage door. They cannot be interchanged because, if inverted, the sheave and roller would be at the top end of the bracket with the roller positioned a short distance below the sheave, approximately 5–6 inches above the bottom of the door. Because of the particular construction of conventional bottom brackets, persons in the garage door trade must carry an inventory of both right hand and left hand bottom brackets. Often, persons repairing a garage door will be unable to complete the repair when they find that they have a supply of right hand bottom brackets when they actually need a left hand bottom bracket, or vice versa. Thus, there is a longfelt need for a universal bottom bracket which is constructed so that it can be installed on either the left hand or right hand side of the garage door.

There are several patents which disclose hardware and fixtures of various construction for overhead garage doors.

Martin, U.S. Pat. Nos. 5,027,494 and 4,934,439 disclose a method and apparatus for adjustably applying tension to a garage door which utilizes a specially shaped strut and bracket apparatus which imparts tension to a section of the door to compensate for misaligned sections which have been curved out of alignment.

Wheatland, U.S. Pat. No. 4,984,387 discloses an adapter for mechanically driven garage doors. The adapter is an elongate U-shaped channel in which a chain is received and has a sprocket on the channel which engages the chain.

Putz, U.S. Pat. No. 4,800,618 discloses a self-sealing device for overhead garage doors which comprises a bracket and a spring driven cam system that is attached to the door track at the roller shaft points when the door is in the closed position.

Sorenson, U.S. Pat. No. 4,378,043 discloses a pivoting screen panel for overhead garage doors which is secured to the bottom and selectively pivots downwardly to provide air circulation to a garage.

The present invention is distinguished over the prior art in general, and these patents in particular by a bottom fixture for overhead garage doors which can be selectively installed on the lower portion of either the right hand or left hand side of the garage door. The bottom fixture is an L-shaped bracket having a wide flat side and a narrow flat side at right angles to one another. A first pair of parallel laterally spaced ear members and a second pair of parallel laterally spaced ear members extend perpendicular to the same surface of the wide side and each pair is spaced a predetermined distance from the top and bottom ends of the bracket and each pair of laterally spaced ears has axially aligned apertures on a horizontal axis to receive the shaft of a roller device having a roller rotatably mounted at its outer end. A first and second sheave extend perpendicular to the same surface of the narrow side on a horizontal axis and are spaced from the top and bottom ends a predetermined distance and are configured to receive a cable. The bracket member can be selectively inverted and secured on either the right hand side or left hand side of the overhead garage door with the shaft of the roller device selectively installed in either of the first or said second pair of ears with the roller disposed on the outer side edge of the overhead garage door and with the first and second sheaves disposed on the outer side edge of the overhead garage door and the cable slidably engaged with the lowermost sheave. The bracket may also be made with only a pair of sheaves or with only two pairs of ears.

SUMMARY OF THE INVENTION

It is therefore an object of the present invention to provide a bottom fixture for overhead garage doors which can be installed on either side of the garage door.

It is another object of this invention to provide a bottom fixture for overhead garage doors which will eliminate the need to carry a large inventory of both right hand and left hand bottom fixtures.

Another object of this invention is to provide a bottom fixture for overhead garage doors which can be installed easily and quickly on either the right hand or left hand side of the garage door without modification or special tools.

A further object of this invention is to provide a bottom fixture for overhead garage doors which will reduce the cost of inventory of specialized hardware and save time in repairing and retrofitting overhead garage doors.

A still further object of this invention is to provide a bottom fixture for overhead garage doors which is simple in construction, economical to manufacture, and rugged in use.

Other objects of the invention will become apparent from time to time throughout the specification and claims as hereinafter related.

The above noted objects and other objects of the invention are accomplished by a bottom fixture for overhead garage doors which can be selectively installed on the lower portion of either the right hand or left hand side of the garage door. The bottom fixture is an L-shaped bracket having a wide flat side and a narrow flat side at right angles to one another. A first pair of parallel laterally spaced ear members and a second pair of parallel laterally spaced ear members extend perpendicular to the same surface of the wide side and each pair is spaced a predetermined distance from the top and bottom ends of the bracket and each pair of laterally spaced ears has axially aligned apertures on a horizontal axis to receive the shaft of a roller device having a roller rotatably mounted at its outer end. A first and second sheave extend perpendicular to the same surface of the narrow side on a horizontal axis and are spaced from the top and bottom ends a predetermined distance and are configured to receive a cable. The bracket member can be selectively inverted and secured on either the right hand side or left hand side of the overhead garage door with the shaft of the roller device selectively installed in either of the first or said second pair of ears with the roller disposed on the outer side edge of the overhead garage door and with the first and second sheaves disposed on the outer side edge of the overhead garage door and the cable slidably engaged with the lowermost sheave. The bracket may also be made with only a pair of sheaves or with only two pairs of ears.

DESCRIPTION OF THE PREFERRED EMBODIMENT

Figure 1:
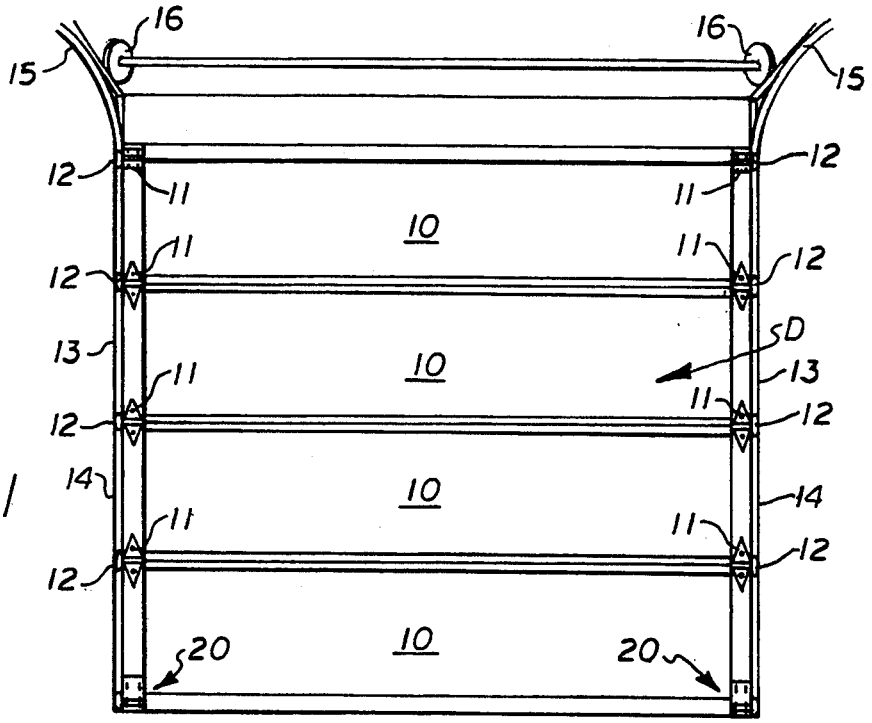
FIG. 1 is an elevation of a conventional overhead garage door having a bottom fixture in accordance with the present invention installed on the bottom panel of the door.

Referring to the drawings by numerals of reference, there is shown in FIG. 1, a conventional overhead garage door D. The conventional overhead garage door D is formed of a plurality of horizontally oriented rectangular sections or panels 10 hinged together along adjacent longitudinal edges. Roller brackets 11 are mounted on the laterally opposed ends of the horizontal panels which have small wheels or rollers 12. The rollers 12 of the roller brackets ride in laterally opposed tracks 13 having a vertical portion 14 mounted at each side of the door opening and curve at their top ends to form a horizontal portion 15 which is mounted parallel to the ceiling of the enclosure. Pulleys 16 are mounted at the top of each side of the door opening.

Bottom fixtures 20 in accordance with the present invention are mounted at the bottom of the laterally opposed edges of the lowermost horizontal panel 10 of the door and have outwardly facing sheaves (described hereinafter). A cable is attached at one end to a tension spring mounted on the horizontal portion of each track and extends horizontally passing over the pulley then vertically downward passing under the sheave of the bottom fixture 20 and then vertically upward where it is secured to the track. The cable and spring are of conventional well known construction and therefore not shown.

Figure 2:
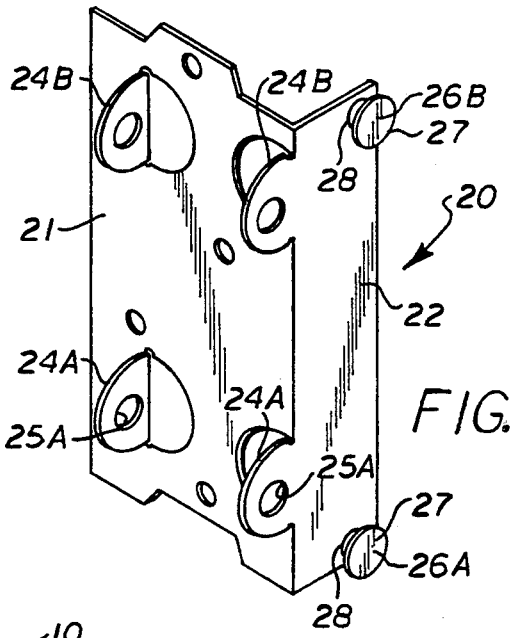
FIG. 2 is an isometric view of the bottom fixture for overhead garage doors showing the dual ear and sheave arrangement.

Referring now to FIG. 2, the present bottom fixture 20 is L-shaped in transverse cross section forming a wide flat side 21 and a narrow flat side 22 at right angles to one another. When installed on the lowermost door panel, the wide side 21 fits on the horizontal side of the door and the narrow side 22 fits on the side edge of the door facing the track. Mounting holes 23 are provided in the wide side 21 for securing the fixture to the door panel with screws, bolts, or other conventional means. The preferred bottom fixture is stamped out of metal and galvanized.

The wide side 21 of the fixture 20 has a first pair of parallel laterally spaced ears 24A that extend perpendicular to the surface near the bottom end and have axially aligned apertures 25A which receive the shaft of a conventional roller (not shown). The narrow side 22 of the fixture 20 has a sheave 26A which extends perpendicular to the surface at the bottom end below the axis of the ears 24 and parallel thereto.

The wide side 21 of the fixture 20 has a second pair of parallel laterally spaced ears 24B that extend perpendicular to the surface near the top end and have axially aligned apertures 25B which receive the shaft of a conventional roller (not shown). The narrow side 22 of the fixture 20 has a sheave 26B which extends perpendicular to the surface at the top end above the axis of the ears 24B and parallel thereto.

The sheaves 26A and 26B are short rod-like projections having a headed portion 27 at their outer end and a smooth reduced diameter neck portion 28 extending between the surface of the narrow side 21 and the headed portion 27. The conventional cable attached at one end to a tension spring (not shown) mounted on the horizontal portion of each track extends horizontally passing over the pulley 16 then vertically downward passing under the neck portion 28 of the lowermost sheave and then vertically upward where it is secured to the track. When the door is opened the spring tension in the cables pulling upwardly on the bottom fixtures 20 assist in lifting the heavy door.

Figure 3:
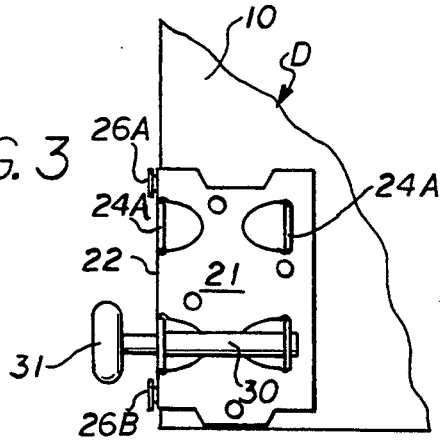
FIGS. 3 and 4 are partial elevation views of the power portion of the left hand and right hand sides, respectively, of a garage door showing how the bottom fixture for overhead garage doors which can be installed on either side of the garage door.
Figure 4:
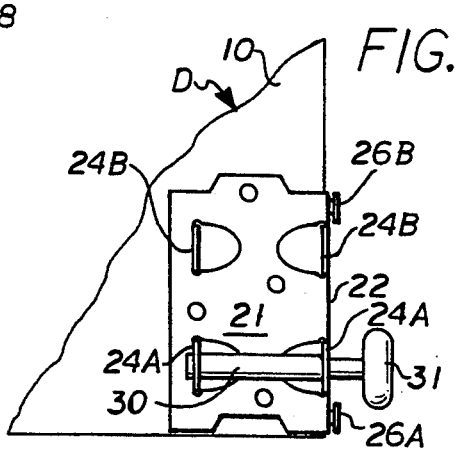

Referring now to FIGS. 3 and 4, it should be noted that the particular construction of the present bottom fixture 20 allows it to be inverted so that it can be installed on either the left hand side (FIG. 3) or the right hand side (FIG. 4) of the garage door D. The spacing of the pairs of the ears 24A and 24B and the sheaves 26A and 26B relative to one another are such that the lowermost ears and sheave will be in the same position relative to the bottom of the door as a conventional bottom bracket when placed on either side of the door.

As seen in FIG. 3, the bottom fixture 20 is installed in an inverted position (compared to FIGS. 2 and 4) on the left hand side of the door D such that the sheave 26A is at the bottom and the ears 24A are just above the sheave 26A. In this position, the shaft 30 of the conventional roller 31 is installed in the ears 24A, and the ears 24B and sheave 26B are not used.

As seen in FIG. 4, the bottom fixture 20 is installed in an inverted position (compared to FIG. 3) on the right hand side of the door D such that the sheave 26B is at the bottom and the ears 24B are just above the sheave 26B. In this position, the shaft 30 of the conventional roller 31 is installed in the ears 24B, and the ears 24A and sheave 26A are not used.

Although the present bottom fixture is illustrated with a pair of sheaves and two pairs of ears in combination, it should be understood that the present bottom fixture can also be made with only a pair of sheaves or with only two pairs of ears for particular applications when only a cable sheave bracket or only a roller bracket is desired.

While this invention has been described fully and completely with special emphasis upon a preferred embodiment, it should be understood that within the scope of the appended claims the invention may be practiced otherwise than as specifically described herein.

I claim:

1. A bottom fixture to be mounted near the bottom of an overhead garage door on either the right or left hand side thereof comprising;

a bracket member having top and bottom ends and a generally L-shaped transverse cross section defining a wide flat side and a narrow flat side at right angles to one another, said wide flat side adapted to be secured on a surface of the overhead garage door with said narrow flat side disposed on an outer side edge of the overhead garage door, first and second sheave means near said top and bottom ends, respectively, extending perpendicularly to an outer surface of said narrow flat side spaced apart in parallel relation on opposite sides of a median plane extending perpendicularly to said flat sides of said bracket and configured to receive a cable, and said bracket member capable of being selectively inverted to be secured on either the right hand side or left hand side of the overhead garage door with said first and second sheave means disposed on the outer side edge of the overhead garage door and the cable slidably engaged with the lowermost said sheave means.

2. The bottom fixture according to claim 1 including;

a first pair of parallel laterally spaced ear members and a second pair of parallel laterally spaced ear members extending perpendicular to an outer surface of said wide flat side, each said pair spaced apart in parallel relation on opposite sides of said median plane, each said pair of laterally spaced ears having axially aligned apertures to receive the shaft of a roller device having a roller rotatably mounted at its outer end, and said bracket member capable of being selectively inverted and secured on either the right hand side or left hand side of the overhead garage door with the shaft of the roller device selectively installed in either of said first or said second pair of ears with the roller disposed on said outer side edge of the overhead garage door.

3. The bottom fixture according to claim 1 including apertures in the surface of said bracket member wide flat side to receive mounting hardware for securing said bracket member to the overhead garage door.

4. The bottom fixture according to claim 1 in which each said sheave means comprises a short rod-like projection having a headed portion at an outer end and a smooth reduced diameter neck portion extending between the surface said bracket member narrow flat side and said headed portion and the cable passing under said neck portion of the lowermost said sheave.

5. The bottom fixture according to claim 1 in which said bracket member is formed of galvanized metal.

6. A bottom fixture to be mounted near the bottom of an overhead garage door on either the right or left hand side thereof comprising;

a bracket member having top and bottom ends and a generally L-shaped transverse cross section defining a wide flat side and a narrow flat side at right angles to one another, said wide flat side adapted to be secured on a surface of the overhead garage door with said narrow side disposed on an outer side edge of the overhead garage door, a first pair of parallel laterally spaced ear members and a second pair of parallel laterally spaced ear members extending perpendicular to an outer surface of said wide flat side, each said pair spaced apart in parallel relation on opposite sides of a median plane extending perpendicularly to said flat sides of said bracket, each said pair of laterally spaced ears having axially aligned apertures to receive the shaft of a roller device having a roller rotatably mounted at its outer end, and said bracket member capable of being selectively inverted and secured on either the right hand side or left hand side of the overhead garage door with the shaft of the roller device selectively installed in either of said first or said second pair of ears with the roller disposed on said outer side edge of the overhead garage door.

7. The bottom fixture according to claim 6 including first and second sheave means near said top and bottom ends, respectively, extending perpendicular to an outer surface of said narrow flat side spaced apart in parallel relation on opposite sides of said median plane and configured to receive a cable, and said bracket member capable of being selectively inverted to be secured on either the right hand side or left hand side of the overhead garage door with said first and second sheave means disposed on said outer side edge of the overhead garage door and the cable slidably engaged with the lowermost said sheave means.

8. The bottom fixture according to claim 7 in which each said sheave means comprises a short rod-like projection having a headed portion at an outer end and a smooth reduced diameter neck portion extending between the surface of said bracket member narrow flat side and said headed portion and the cable passing under said neck portion of the lowermost said sheave.

9. The bottom fixture according to claim 6 including apertures in the surface of said bracket member wide flat side to receive mounting hardware for securing said bracket member to the overhead garage door.

10. The bottom fixture according to claim 6 in which said bracket member is formed of galvanized metal.

11. A bottom fixture to be mounted near the bottom of an overhead garage door on either the right or left hand side thereof comprising;

a bracket member having top and bottom ends and a generally L-shaped transverse cross section defining a wide flat side and a narrow flat side at right angles to one another;

said wide flat side adapted to be secured on a surface of the overhead garage door with said narrow flat side disposed on an outer side edge of the overhead garage door;

a first pair of parallel laterally spaced ear members and a second pair of parallel laterally spaced ear members extending perpendicular to an outer surface of said wide flat side, each said pair spaced apart in parallel relation on opposite sides of a median plane extending perpendicularly to said flat sides, and each said pair of laterally spaced ears having axially aligned apertures to receive the shaft of a roller device having a roller rotatably mounted at its outer end, first and second sheave means near said top and bottom ends, respectively, extending perpendicular to an outer surface of said narrow flat side spaced apart in parallel relation on opposite sides of said median plane and configured to receive a cable, said bracket member capable of being selectively inverted to be secured on either the right hand side or left hand side of the overhead garage door with the shaft of the roller device selectively installed in either of said first or said second pair of ears with the roller disposed on the outer side edge of the overhead garage door and said first and second sheave means disposed on said outer side edge of the overhead garage door and the cable slidably engaged with the lowermost said sheave means.

12. The bottom fixture according to claim 11 in which each said laterally spaced pair of ear members and each said sheave means are aligned on horizontal axes, and the horizontal axis of said first and second sheave means are spaced longitudinally above and below, respectively, the horizontal axis of said first and said second pair of ear members.

13. The bottom fixture according to claim 11 in which each said sheave means comprises a short rod-like projection having a headed portion at an outer end and a smooth reduced diameter neck portion extending between the surface of said bracket member narrow side and said headed portion and the cable passing under said neck portion of the lowermost said sheave.

14. The bottom fixture according to claim 11 including apertures in the surface of said bracket member wide side to receive mounting hardware for securing said bracket member to the overhead garage door.

15. The bottom fixture according to claim 11 in which said bracket member is formed of galvanized metal.

* * * * *